United States Patent [19]

Dallüge

[11] Patent Number: 4,924,650

[45] Date of Patent: May 15, 1990

[54] METHOD FOR THERMALLY INSULATING AN ENCLOSED VOLUME USING AN INFRA-RED RADIATION REFLECTING LAMINATE

[76] Inventor: Jürgen Dallüge, 1148 Sterling Ave., Berkeley, Calif. 94708

[21] Appl. No.: 202,139

[22] Filed: Jun. 3, 1988

[51] Int. Cl.[5] ..... E04B 1/00

[52] U.S. Cl. ..... 52/741; 156/71; 52/407

[58] Field of Search ..... 52/741, 407; 156/71

[56] References Cited

U.S. PATENT DOCUMENTS

| | | | |
|---|---|---|---|
| 4,081,300 | 3/1978 | Willdorf | 156/71 |
| 4,233,791 | 11/1980 | Kuhl et al. | 156/71 X |
| 4,486,997 | 12/1984 | Roy | 52/407 X |
| 4,696,138 | 9/1987 | Bullock | 52/407 |
| 4,707,960 | 11/1987 | Bullock | 52/404 |

*Primary Examiner*—Carl D. Friedman

*Attorney, Agent, or Firm*—Flehr, Hohbach, Test, Albritton & Herbert

[57] ABSTRACT

The present invention provides a novel laminate comprising an inner support layer comprising a cross-laminated polyethylene, a middle layer which is capable of reflecting infra-red radiation comprising a metallized material selected from the group consisting of aluminized polyethylene, polyethylene terephthalate, and metallized polyester, and a protective outer layer which protects the middle metallized layer from corrosion comprising a compound which is substantially transparent in the infra-red wavelength range selected from the group consisting of low molecular weight acrylates, low density polyethylene, polymethylene, diazo methane, and isomerized cyclo-caoutchouc. The present invention also provides a method for thermally insulating a predetermined enclosed volume defined by walls comprising the envelope of the volume comprising the step of lining at least one of the walls with the novel infra-red radiation-reflecting laminate of the present invention.

9 Claims, 3 Drawing Sheets

METHOD FOR THERMALLY INSULATING AN ENCLOSED VOLUME USING AN INFRA-RED RADIATION REFLECTING LAMINATE

FIELD OF INVENTION

The present invention is directed to a laminate which is capable of reflecting a substantial percentage of infra-red radiation and a method for thermally insulating a predetermined enclosed volume defined by walls comprising the envelope of the volume, by utilizing the laminate.

Specifically, the present invention is directed to a laminate comprising an inner support layer comprising a cross-laminated polyethylene, a middle layer capable of reflecting infra-red radiation comprising a metallized material, and a protective outer layer which protects the middle metallized layer from corrosion and is substantially transparent in the infra-red wavelength range. The present invention is further directed to a method for thermally insulating a predetermined enclosed volume defined by walls comprising the envelope of the volume, comprising the step of lining at least one of the walls with the infra-red radiation-reflecting laminate of the present invention.

BACKGROUND

The formation and use of thermal reflectors to provide heat insulation is well known. Thermal reflectors are frequently used to insulate buildings from heat gain or loss. The thermal reflector reflects infra-red radiation, thereby keeping the impending radiant energy, or heat from the sun away from the interior of a building or other enclosure. In this manner, the building is kept cool, minimizing the energy required to cool the interior of the building, by air-conditioning or fans.

The industry has utilized a variety of metallic reflector products that reflect infra-red radiation. The majority of these reflectors are paper-backed metallized reflectors that are not durable and corrode when subjected to moisture, salt spray or intense heat.

Layers of goldized film have also been used in multilayered insulation blankets by NASA satellites in space to protect against the impact of infra-red radiation. Gold has been used because other metallized films corrode when exposed to humidity, moisture, or salt spray. Thermal reflectors which use gold or other valuable metals are disadvantageous, however, in that they are costly and of limited availability.

As more stringent demands are made upon the construction industry to provide buildings which are energy and cost-efficient, the need for more inexpensive, durable and efficient thermal insulators is increasingly prevalent.

SUMMARY OF THE INVENTION

The present invention provides a novel laminate comprising an inner support layer comprising a cross-laminated polyethylene, a middle layer which is capable of reflecting infra-red radiation comprising a metallized material selected from the group consisting of aluminized polyethylene, polyethylene terephthalate, and metallized polyester, and a protective outer layer which protects the middle metallized layer from corrosion comprising a compound which is substantially transparent in the infra-red wavelength range selected from the group consisting of low molecular weight acrylates, low density polyethylene, polymethylene, diazo methane, and isomerized cyclo-caoutchouc. The present invention also provides a method for thermally insulating a predetermined enclosed volume defined by walls comprising the envelope of the volume comprising the step of lining at least one of the walls with the novel infra-red radiation-reflecting laminate of the present invention.

It is therefore an object of the present invention to provide a novel and improved laminate which is capable of reflecting a substantial percentage of infra-red radiation.

It is another object of the present invention to provide a novel and improved laminate that is less costly and more easily available than laminates previously used to reflect infra-red radiation.

It is still another object of the present invention to provide a novel and improved laminate that is sensitive in the infra-red region of the spectrum.

It is another object of the present invention to provide a novel and improved laminate that can withstand moisture, intense heat, and salt spray with minimal corrosion.

It is another object of the invention to provide a method for thermally insulating a predetermined enclosed volume defined by walls comprising the envelope of the volume, by lining at least one of the walls with the novel and improved infra-red radiation-reflecting laminate of the present invention.

DETAILED DESCRIPTION OF THE PREFERRED EMBODIMENTS

The laminate of the present invention can be composed of at least three distinct layers. The first layer is an inner support layer comprising a cross-laminated polyethylene. A middle layer is deposited on the inner support layer which is capable of reflecting infra-red radiation comprising a metallized material selected from the group consisting of aluminized polyethylene, polyethylene terephthalate and metallized polyester. A protective outer layer is formed over the middle metallized layer which protects the middle layer from corrosion. The outer layer preferably comprises a compound which is substantially transparent in the infra-red wavelength range selected from the group consisting of low molecular weight acrylates, low density polyethylene, polymethylene, diazo methane, and isomerized cyclo-caoutchouc.

The method of the present invention for thermally insulating a predetermined enclosed volume defined by walls comprising the envelope of the volume comprises the step of lining at least one of the walls with the infra-red radiation-reflecting laminate of the present invention. This method will be more fully described hereinafter.

As used herein, "walls" include upright structures, both for support and enclosure, with degrees of inclination both $\leqq 65°$ and $>65°$, such as roofs.

In an alternative embodiment, the laminate of the present invention can be comprised of an inner support layer comprising cross-laminated polyethylene, an adhesive layer positioned on the inner support layer, a middle metallized layer which is capable of reflecting infra-red radiation comprising a metallized material selected from the group consisting of aluminized polyethylene, polyethylene terephthalate and metallized polyester, and which is capable of receiving the adhesive layer, and a protective outer layer which protects the middle layer from corrosion, comprising a compound which is substantially transparent in the infra-red wavelength range selected from the group consisting of low molecular weight acrylates, low density polyethylene, polymethylene, diazo methane and isomerized cyclo-caoutchouc. The adhesive layer facilitates improved binding strength between the middle metallized layer and the inner support layer.

Figure 1:
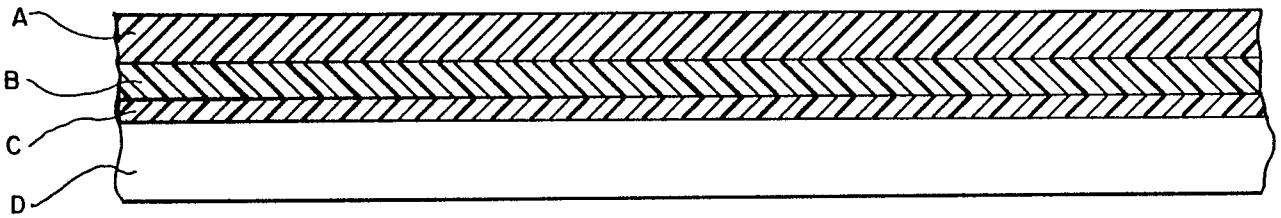
FIG. 1 is a schematic diagram showing the construction of the laminate of the present invention.

Referring to FIG. 1, one embodiment of the construction of the laminate of the present invention is shown. Adhesive layer C is deposited on inner support layer D. The middle metallized layer (B) is capable of reflecting infra-red radiation and is deposited onto the adhesive layer, for example, by vapor-depositing. An outer protective layer is then deposited over the middle metallized layer (A) to prevent corrosion of the middle layer. In an alternate configuration, the laminate can be double-sided, so that on each side of an inner support layer (D) there is deposited an adhesive layer (C), on each layer (C) a middle metallized layer (B) is deposited and on each middle layer there is deposited another protective layer (A).

In constructing the laminate, it is preferable that the inner support layer is comprised of cross-laminated polyethylene to increase the stability and durability of the laminate for construction. The thickness of the inner support layer is preferably in the range from about 3.0 mil to about 3.5 mil to achieve sufficient stability, yet retain some flexibility.

The middle layer of the laminate is capable of reflecting infra-red radiation comprising a metallized material selected from the group consisting of aluminized polyethylene, polyethylene terephthalate and metallized polyester. It is generally known that due to the high density of free electrons, a metal layer is able to reflect electromagnetic radiation at a layer thickness considerably smaller than the wavelength of the radiation. In a preferred embodiment, the middle metallized layer has a thickness in the range from about 4 μm to about 30 μm. A metallized layer of thickness greater than 30 μm is possible, but does not result in further improved reflectivity. A metallized layer as described herein wherein the thickness ranges from about 4 μm to about 30 μm ensures that the metallized layer will not break apart by rolling, stretching or deforming of the product. A maximum thickness of 30 μm ensures maximum reflectivity of thermal radiation and energy, and appreciably stiffens the laminate providing support, while still retaining enough flexibility so that the laminate can be handled without difficulty. In one embodiment, the middle metallized layer is made of a polyethylene terephthalate such as mylar.

The middle metallized layer can be either perforated or unperforated, depending on production costs.

In one embodiment, the middle metallized layer of the laminate of the present invention can be vapor-deposited onto the inner support layer by a process which shall be further described herein.

A laminate with a middle metallized layer as described, with a thickness of approximately 30 μm, has been shown to be capable of reflecting up to 96% of infra-red radiation. ASHRAE Handbook, American Society of Heating, Refrigerating and Air Conditioning Engineers, Inc., Chapter 22, Table 2, p. 22.12 (1985).

The laminate of the present invention further comprises a protective outer layer which protects the middle metallized layer from corrosion, comprising a compound that is substantially transparent in the infra-red wavelength range selected from the group consisting of low molecular weight acrylates, low density polyethylene, polymethylene, diazo methane, and isomerized cyclo-caoutchouc.

The outer layer of the laminate should be substantially transparent in the wavelength range from about 4 μm to about 20 μm to retain high thermal reflectivity. Thus, the outer layer remains substantially transparent over the entire spectral range of thermal radiation. The thickness of the outer layer is selected so that it is substantially free of pores in order to prevent corrosion of the middle metallized layer.

In a preferred embodiment, the outer layer of the laminate of the present invention should have a thickness in the range from about 2.0 μm to about 4.0 μm to achieve the goal of having high thermal reflectivity in the infra-red spectral range.

The present invention is also directed to a method for thermally insulating a predetermined enclosed volume defined by walls comprising the envelope of the volume, comprising the step of lining at least one of the walls with the infra-red radiation-reflecting laminate of the present invention.

Figure 2:
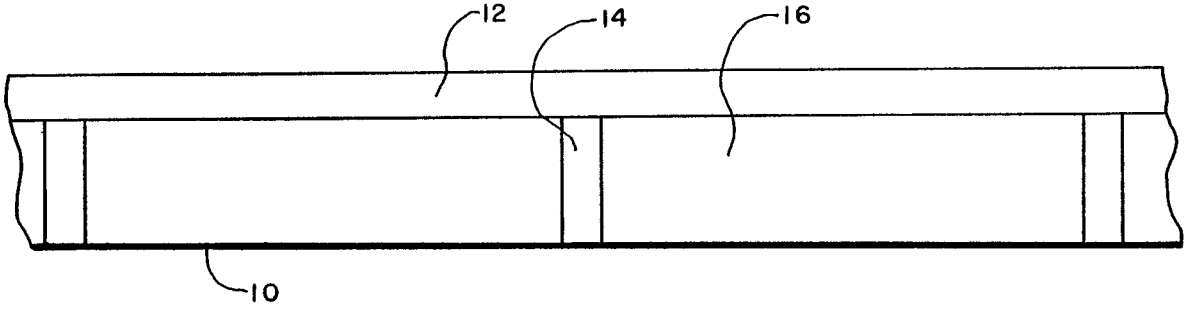
FIG. 2 shows one embodiment of the laminate of the present invention used as a thermal insulator in a predetermined enclosed volume defined by walls which comprise the envelope of the volume.

FIG. 2 shows one embodiment of the laminate of the present invention used as a thermal insulator in a predetermined enclosed volume defined by walls which comprise the envelope of the volume. Laminate 10 is shown spread across rafters 14 of roof 12. An air space is left between roof 12 and laminate 10. Thus, when infra-red radiation is directed towards roof 12 it is reflected by laminate 10 away from the interior of the building, keeping the building cool.

Figure 3:
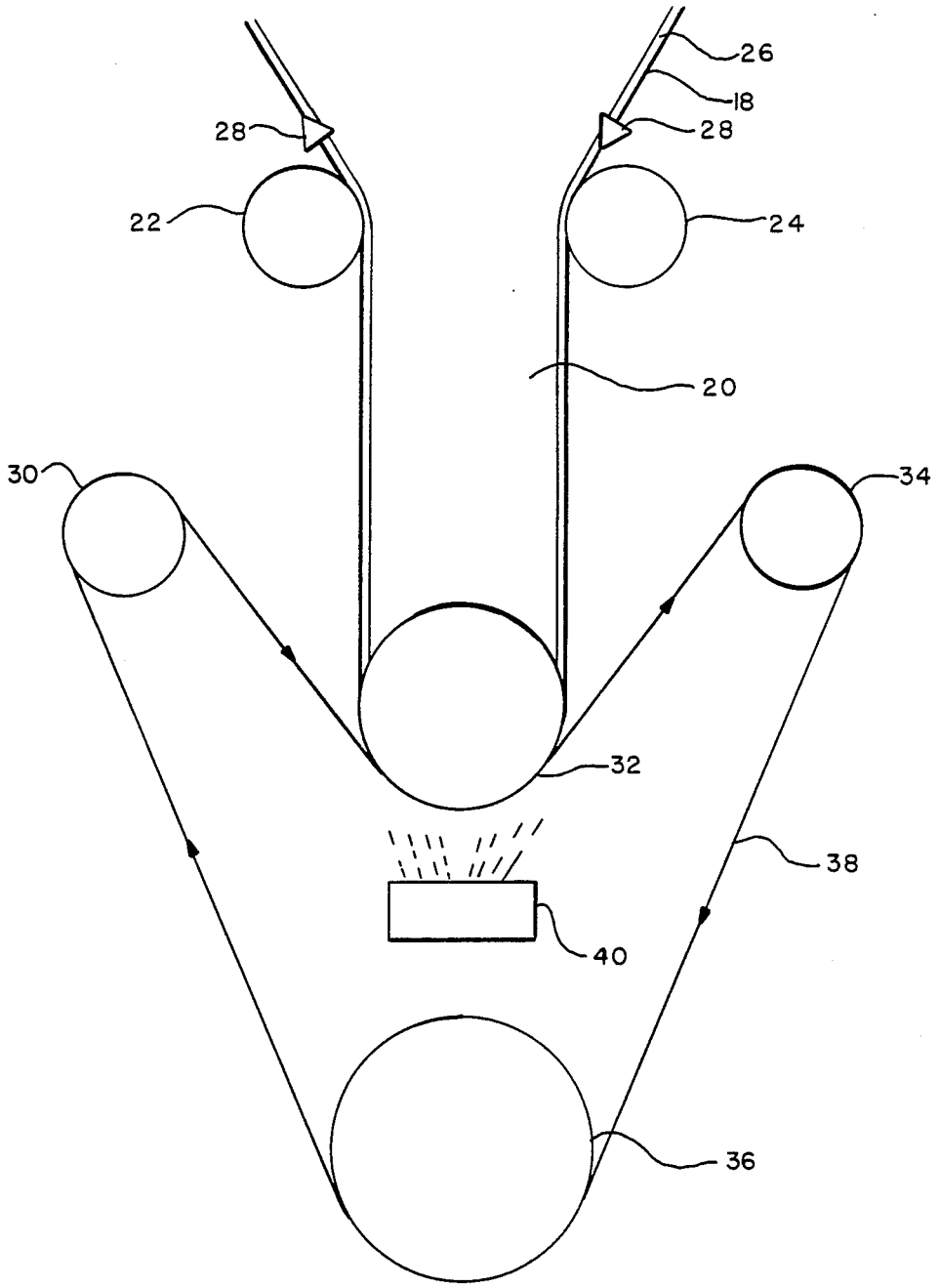
FIG. 3 is a schematic diagram showing one embodiment of the method of producing the laminate of the present invention.

Referring to FIG. 3, a schematic drawing shows one embodiment of the method of producing the laminate of the present invention. Substrate 18 on belt 26 runs around roll 20. Belt 26 can have an adhesive coating already applied to it which can thereafter be coated with the metallized layer. Belt 26 is guided by rolls 22 and 24 in a manner so that belt 26 bears on roll 20 preferably over three-quarters of its circumference. Roll 20 turns in the direction of arrows 28.

A metal vaporization source 40 is provided to deposit the vaporized metal of the middle metallized layer onto belt 26. Also provided is endless belt 38 which is preferably constructed of wire net or mesh to form a mask. Endless belt 38 runs over rolls 30, 32, 34 and 36 in the direction of the indicated arrows preferably at the same speed as roll 20.

Belt 38 bears on substrate 18 on the side of belt 26 facing vaporization source 40 after it has passed around roll 34. Belt 38 is then separated from the surface on belt 26 after it has passed through the vaporization zone via roll 34 and has returned by means of rolls 32 and 36 to roll 34 at the inlet of the vaporization zone. During its passage through the vaporization zone, belt 38 bears on substrate 18 resulting in the metal being vapor-deposited only on the portion of the surface of substrate 18 exposed by belt 26. After the metal coat has been freed of unconnected inlets, the outer protective layer is applied in the same manner, as herein described.

In a preferred embodiment, roll 20 should be kept at a steady speed of 82 meters per second (2.8%) to ensure uniform thickness of the vaporized metal on the middle metallized layer.

Preferably, the outer protective coating should be kept at a temperature of 32° C.±2% so that the coating will be able to compensate the stress of approximately 5% heat absorption from thermal radiation.

EXAMPLE 1

One embodiment of the laminate of the present invention was tested for tear resistance and puncture resistance. The test specimens were conditioned at 73.4° F.±1.8° F. and a relative humidity of 50±2% prior to testing. The results are summarized in Table 1 below.

TABLE I

MASS PER UNIT AREA, TEAR RESISTANCE AND PUNCTURE (BEACH) RESISTANCE

| Test Performed | Direction | Average | Range |
|---|---|---|---|
| 1. Mass per Unit Area (Weight), grams/sq. meter | — | 104 | — |
| 2. Tear Resistance*, 1 bf. | 1 | 6.8 | 6.2–7.7 |

TABLE I-continued

MASS PER UNIT AREA, TEAR RESISTANCE AND PUNCTURE (BEACH) RESISTANCE

| Test Performed | Direction | Average | Range |
|---|---|---|---|
| | 2 | 6.2 | 5.4–7.2 |
| 3. Thickness, inch | — | 0.0045 | 0.0044–0.0046 |
| 4. Puncture Resistance, beach units | | | |
| (a) White Side | 1 | 215 | 135–295 |
| | 2 | 270 | 265–275 |
| | Overall Avg. | 242 | |
| (b) Silver Side (shiny) | 1 | 190 | 170–210 |
| | 2 | 170 | 160–180 |
| | Overall Avg. | 180 | |

NOTE:
*Each reported average value for test resistance represents the average of 10 readings taken per each direction of the sample.

The mass per unit area was determined by using the test, TAPPI T-410, "Grammage of Paper and Paperboard (Weight per Unit Area)." The mass per unit area is expressed in grams per square meter.

Tear resistance was determined by the standard test ASTM D1004, "Standard Test Method for Initial Tear Resistance of Plastic Film and Sheeting, " using a CRE-type tensile tester operated at a cross-head speed of 2 in./min.

Puncture resistance (Beach) was determined by the standard test, ASTM D781, "Standard Test Methods for Puncture and Stiffness of Paperboard, and Corrugated and Solid Fiberboard."

EXAMPLE II

One embodiment of the laminate of the present invention was tested for ultimate tensile strength and elongation. The results are summarized in Table II below.

TABLE II

ULTIMATE TENSILE STRENGTH AND ELONGATION BEFORE AND AFTER WEATHERING (300 HOURS)

| | Direction | Before Weathering (Original Condition) Average* | Before Weathering (Original Condition) Range | After Weathering Average* | After Weathering Range | % Loss (As a % of Original) |
|---|---|---|---|---|---|---|
| 1. Tensile Strength at Break, psi | 1 | 7000 | 6800–7210 | 4460 | 4200–4820 | 36 |
| | 2 | 5940 | 5770–6050 | 3170 | 3070–3260 | 47 |
| 2. Elongation at Break, % | 1 | 101 | 95–108 | 39 | 29–68 | 61 |
| | 2 | 120 | 114–122 | 9 | 8–10 | 93 |

NOTE:
*Each reported average value represents the average of 5 readings taken per each direction of the example.

Ultimate tensile strength and elongation were determined by ASTM D882, "Standard Test Methods for Tensile Properties of Thin Plastic Sheeting," both before (i.e., as received) and after 300 hours accelerated weathering exposure per FTMS 191, Method 5804, "Weathering Resistance of Cloth: Accelerated Weathering Method" (Sunshine Arc Weatherometer) and referenced AATCC Test Method 111A, "Weather Resistance: Sunshine Arc Lamp Exposure with Wetting."

The weathering was conducted with Corex D glass filters, at a black panel temperature of 68±5° C., and with successive cycles of 102 minutes of light without spray followed by 18 minutes of light with water spray.

What is claimed is:

1. A method for thermally insulating a predetermined enclosed volume defined by walls comprising the envelope of said volume comprising the step of lining at least one of said walls with an infra-red radiation-reflecting laminate, wherein said laminate comprises:

(a) an inner support layer comprising a cross-laminated polyethylene;

(b) a middle layer which is capable of reflecting infra-red radiation comprising a metallized material selected from the group consisting of aluminized polyethylene, polyethylene terephthalate and metallized polyester; and (c) a protective outer layer which protects said middle metallized layer from corrosion, comprising:

a compound which is substantially transparent in the infra-red wavelength range selected from the group consisting of low molecular weight acrylates, low density polyethylene, polymethylene diazo methane, and isomerized cyclo-caoutchouc.

2. A method according to claim 1 wherein the thickness of said inner support layer is in the range from about 3.0 mil to about 3.5 mil.

3. A method according to claim 1 wherein the thickness of said middle metallized layer is in the range from about 4 μm to about 30 μm.

4. A method according to claim 1 wherein said metallized layer is vapor-deposited onto said inner support layer.

5. A method according to claim 1 wherein said metallized layer is unperforated.

6. A method according to claim 1 wherein said metallized layer is perforated.

7. A method according to claim 1 wherein said metallized layer is capable of reflecting up to 96% of infra-red radiation.

8. A method according to claim 1 wherein said outer layer has a thickness in the range from about 2.0 μm to about 4.0 μm.

9. A method according to claim 1 wherein said outer layer is substantially transparent in the wavelength range from about 4 μm to about 20 μm.

* * * * *